US006581720B1

(12) United States Patent
Chen et al.

(10) Patent No.: US 6,581,720 B1
(45) Date of Patent: Jun. 24, 2003

(54) NOISE ATTENUATING INSULATED HEAT SHIELD

(75) Inventors: Colin Ching-Ho Chen, Barrington, IL (US); Mark Boogemans, Belmont (CA); Calin Matias, London (CA)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/999,552

(22) Filed: Nov. 30, 2001

(51) Int. Cl.[7] ..... G10K 11/00

(52) U.S. Cl. ..... 181/205; 181/204; 181/198; 181/207; 181/208

(58) Field of Search ..... 181/205, 198, 181/200, 202, 203, 204, 206–208

(56) References Cited

U.S. PATENT DOCUMENTS

| | | | | |
|---|---|---|---|---|
| 2,288,172 A | | 6/1942 | Ulrich | 248/610 |
| 4,433,542 A | | 2/1984 | Shimura | 60/299 |
| 4,456,092 A | * | 6/1984 | Kubozuka et al. | 181/290 |
| 4,507,917 A | | 4/1985 | Kandler | 60/323 |
| 4,646,864 A | * | 3/1987 | Racchi | 180/69.22 |
| 4,655,496 A | * | 4/1987 | Gahlau et al. | 296/39.3 |
| 5,590,524 A | | 1/1997 | Moore, III et al. | 60/323 |

FOREIGN PATENT DOCUMENTS

| | | | |
|---|---|---|---|
| GB | 2185627 | * | 7/1987 |

* cited by examiner

*Primary Examiner*—Shih-Yung Hsieh

(57) ABSTRACT

An improved heat shield offers both a thermal insulation and reduced noise transmission for vehicular engine components, including exhaust manifolds, for example. The structure has three layers: an outer structural metal layer, a center insulation layer to isolate heat and dampen noise, and an inner metal layer directly adjacent the shielded component for reflecting heat back to the shielded component. As disclosed, the heat shield includes at least one bolt aperture for attachment of the shield to a shielded component, such as an exhaust manifold in the described embodiment. The aperture is circumferentially bordered by at least one non-planar undulation defining a protuberance. The protuberance is spaced circumferentially about the aperture. As the bolted connection of the heat shield to the manifold is a major source of vibration transmittal from the manifold into the shield, the protuberance is effective to dampen the vibration, and hence noise associated with the vibration.

12 Claims, 2 Drawing Sheets

NOISE ATTENUATING INSULATED HEAT SHIELD

BACKGROUND OF THE INVENTION

1. Field of Invention

The present invention relates to protective structures for vehicular engine parts, such as engine exhaust manifolds for example, that generate substantial heat and vibration during engine operation. More specifically, the invention relates to fabrication of protective heat shields applied to such engine parts for insulating such parts from other components within an engine compartment of a vehicle, and particularly to a novel structure for reducing noise generated by such shields.

2. Description of the Prior Art

The exhaust manifolds of internal combustion engines in today's modern vehicles can reach under-the-hood temperatures in the neighborhood of 1600 degrees Fahrenheit. Such high temperatures create significant risks of damage to electronic components sharing under-the-hood space with the manifolds. Thus, protection has been provided for such components via use of heat shields designed to at least partially cover up and insulate exhaust manifolds and other heat generating component. In some cases, the shields have been effective to reduce measured temperature levels to within a range of 300 degrees Fahrenheit.

One recurrent shortcoming with respect to current shield designs, however, has been with their inability to reduce or attentuate noise down to satisfactory levels. Unfortunately, the structures for producing heat shields tend to be relatively stiff and thin, and thus prone to producing echoes rather than to absorb vibrations and/or noise.

SUMMARY OF THE INVENTION

The present invention provides an improved insulated heat shield for engine components, such as exhaust manifolds of internal combustion engines. In the described embodiment, a heat shield is formed as a unitary structure adapted for securement via bolted connection to an engine manifold, and includes three layers; an outer metal layer to provide overall structural integrity, a center layer formed of an insulation material to isolate heat and to dampen noise, and an inner metal layer adjacent the shielded component for reflecting heat back to the shielded component.

In the described embodiment, the insulated heat shield includes at least one bolt aperture for attachment of the shield to an under-the-hood shielded component, such as an exhaust manifold. The bolt aperture is fully surrounded, i.e., circumferentially bordered, by at least one non-planar undulation. The undulation defines a single circular protuberance that is spaced circumferentially about the aperture in a first described embodiment. A pair of protuberances, concentric or otherwise, is situated circumferentially about the bolt aperture in a second described embodiment. Because the bolted attachment of the insulated heat shield to the manifold presents a major source of vibration transmittal from the manifold into the heat shield, the protuberance(s) is (are) effective to dampen such vibration, and hence reduce undesirable noise associated with the vibration.

DETAILED DESCRIPTION OF THE PREFERRED EMBODIMENTS

Figure 1:
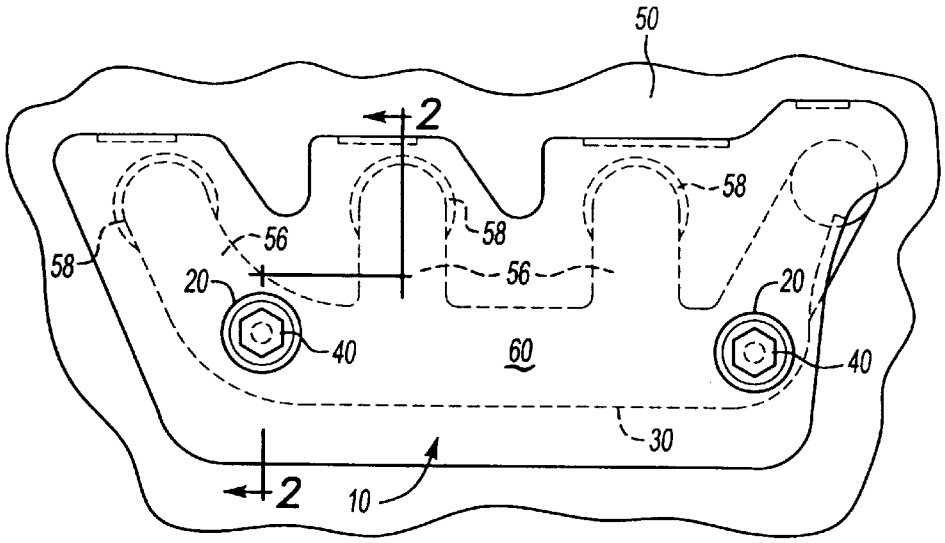
FIG. 1 is a side elevation view of one described embodiment of the heat shield of the present invention installed over an exhaust manifold (shown in phantom) of an internal combustion engine (shown fragmentarily).
Figure 2:
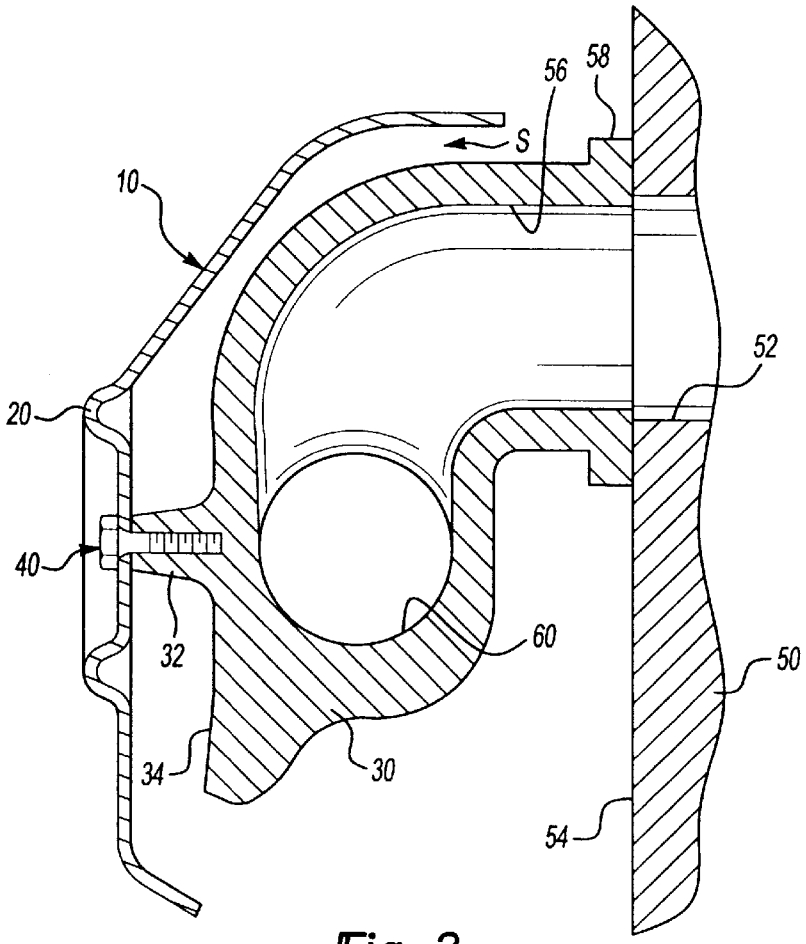
FIG. 2 is a cross-sectional view of the heat shield of FIG. 1, shown installed over an exhaust manifold in accordance with the present invention, as viewed along lines 2—2 of FIG. 1.

Referring initially to FIGS. 1 and 2, a multi-layered heat shield 10 is adapted to encase or closely surround at least portions of an under-the-hood engine component 30. In the described embodiment, the component 30 (shown in phantom in FIG. 1) is a heavy-duty cast-iron exhaust manifold (30). The manifold 30 is bolted via bolts (not shown) to a plurality of engine exhaust ports 52 on the flank or side 54, of an internal combustion engine 50 (shown fragmentarily). The manifold 30 includes cooperating ports 56 having associated mounting bosses 58 for securement of the manifold 30 to the plurality of engine exhaust ports 52.

The engine exhaust ports 52 operate to collectively receive exhaust gases from individual combustion chambers (not shown) of the engine 50, and to funnel those exhaust gases into a common exhaust pipe portion 60 of the manifold 30. An exhaust pipe flange (not shown) is integrally provided at an end of the exhaust pipe portion 60 for securement to a separate exhaust pipe (not shown) to facilitate passage of exhaust gases from the engine 50 to the atmosphere.

Figure 3:
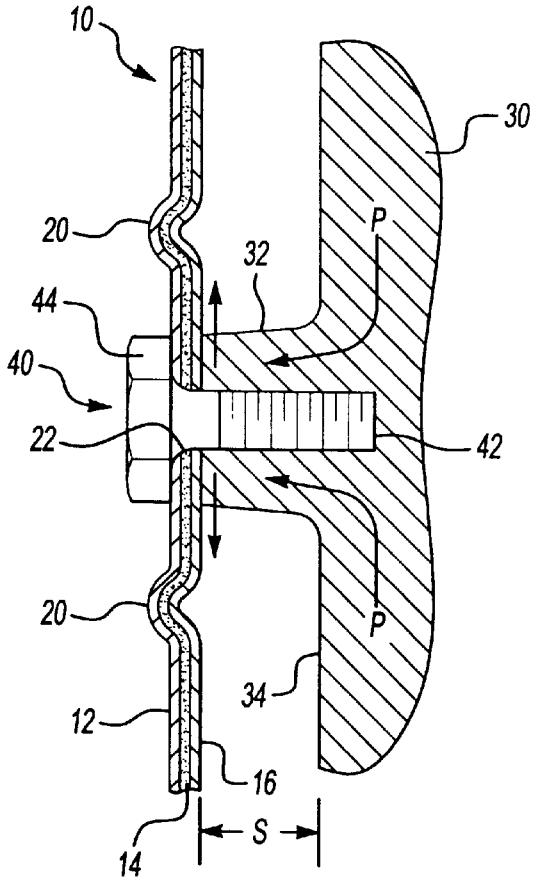
FIG. 3 is a portion of the heat shield of FIG. 2, displaying an enlarged cross-sectional view of a circular protuberance constructed in accordance with the present invention.

A particular aspect of this invention relates to control of vibration and noise attenuation properties of the shield 10, particularly as related to the means by which the shield 10 is attached to an engine component, such as the manifold 30. Referring now also to FIG. 3, an enlarged view of a bolt attachment boss 32 of the manifold 30 is shown in greater detail. The heat shield 10 is secured to the manifold 30 by bolts 40 that extend through apertures 22 of the shield 10. For this purpose, the exterior surface 34 of the manifold 30 includes at least two bolt attachment bosses 32 (FIG. 1) that are positioned on and protrude from the exterior surface 34 of the manifold 30. It will further be noted that the heat shield 10 is displaced away from the surface 34 by an air space indicated as S. Those skilled in the art will appreciate that the air space S is effective to impart an insulating effect in addition to that imparted by the actual construction of the heat shield 10.

Those skilled in the art will also appreciate that noise and vibration are transmitted from the engine 50 and into the manifold 30. The vibration then travels from the manifold 30 through the paths P (FIG. 3), and will tend to vibrate the heat shield 10. The transmittal of vibration is particularly exascerbated by the bolts 40, each having a shank portion 42 attached to a head portion 44, and secured in a manner such as to rigidly retain the shield 10 between the head 44 and the boss 32.

If not arrested or at least attenuated, those skilled in the art will further appreciate that the vibration will travel through the boss 32 and bolt 40 and radially outwardly into the structure of the shield 10. Conversely, an interruption or break in the paths P is provided in the present invention by the inclusion of a non-planar undulation 20 about each bolt 40. Such an undulation 20 is effective to suppress the transmittal of vibration, and hence noise, from the manifold 30, and hence into the shield 10 by 2 to 4 decibels, a significant amount in the described environment. In the described embodiment each undulation 20 is defined by a circular protuberance 20 (FIG. 1), and is shown in cross-section in FIGS. 2 and 3. In the first described embodiment as depicted, each circumferential protuberance comprises a convex visible ring about the apertures 22 and corresponding bolt head portion 44.

A second embodiment, not shown, provides at least two of such undulations, defining visible, concentrically positioned rings, formed about the aperture 22. In some arrangements, the undulations may be slightly offset or nonconcentric, depending on geometry of the shield 10, for achieving optimal effectiveness of vibration and noise dampening.

Figure 4:
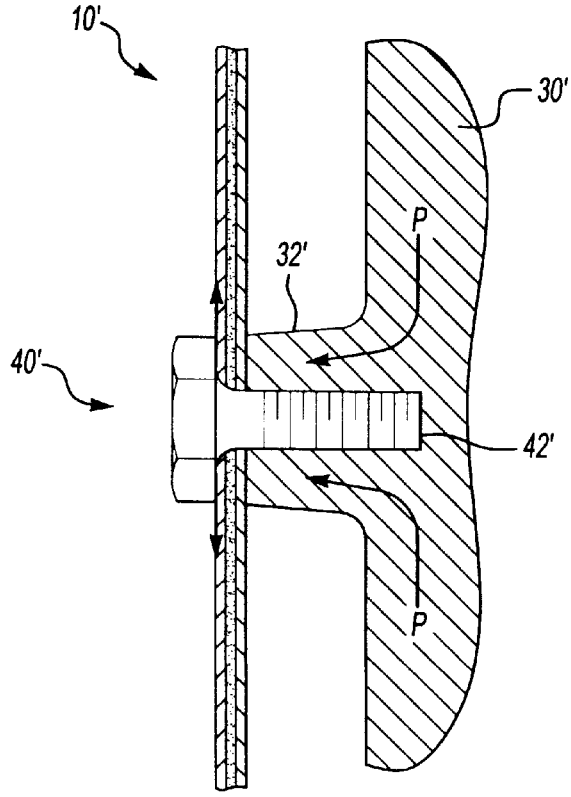
Fig-4 PRIOR ART
FIG. 4 is a cross-sectional view of a portion of a prior art heat shield, displayed for comparative discussion purposes, only.

For comparative purposes, a heat shield embodiment 10' of the prior art is depicted in FIG. 4. The heat shield embodiment 10' incorporates no undulation or protuberance 20 as described. The paths P' of noise and vibration through the manifold 30' travel through the bolt shank 42' and into the body of the shield 10'. Without any arresting structure such as the undulations 20, those skilled in the art will appreciate that the vibration will be free to travel uninterruptedly, and hence in an undamped manner, throughout the entire body of the shield 10'.

Referring back to FIG. 3, the heat shield 10 has a body consisting of three layers; an external or outer metal layer 12 to provide structural integrity and overall rigidity, a center layer 14 of thermal insulation material to isolate temperature and to dampen vibration and noise, and an inner metal layer 16 adjacent the shielded component for reflecting heat back to the shielded component. The respective layers are sandwiched together to form a unitary body as particularly shown in FIG. 3.

The outer metal layer may be preferably formed of cold rolled steel, aluminized steel, aluminum, and even stainless steel for more exotic vehicles where cost is less of a factor. If cold rolled steel is utilized, the exterior of the shield may be coated with a corrosion-resistant material to enhance longevity of the shield.

The inner metal layer 16 is the portion of the shield 10 in closest contact with the exhaust manifold. To the extent that the temperatures of the manifold can reach the 1600 degrees Fahrenheit range, the material of the inner metal layer should be able to withstand significant heat. In some applications the inner layer may be relatively shiny, formed of high-temperature alloys, and adapted to reflect heat back to the shielded component. In others, the inner layer 16 can be of cheaper materials including aluminum-clad steel. Those skilled in the art will appreciate that choice of materials may be critical for avoiding degradation associated with elevated temperatures and for handling considerable vibrations in particular applications.

Although described with three layers, the shield 10 could be effectively manufactured without the outer layer 12 for some lower budget shields. The inner layer 16 would provide the requisite stiffness and support in such cases, but may need to be relatively thicker in some applications.

The material choices for the thermally insulating and vibration and noise dampening center layer 14 are fairly broad. Such choices may include non-metallic fibers such as aramid fibers, or ceramic fiber paper. Depending on anticipated temperature ranges, even non-fiber compositions may be employed, such as densified vermiculite powders, for example.

One method of manufacturing of the heat shield 20 can be described as follows. Each of the inner and outer metal layers 16, 12 are stamped from sheet metal, and formed in a progressive die to the shapes depicted, including the described protuberances of this invention. The insulation layer 14 is then applied against the outer metal layer 12, and the inner metal layer 16 is placed atop the insulation layer.

Ideally, the outer layer 12 will be relatively and slightly oversized compared to inner layer 16, so that edges (not shown) of the layer 12 may be folded over respective mated edges of the inner metal layer, effectively encapsulating the insulation layer 14 between the metal layers 12 and 16.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A heat shield for an under-the-hood vehicular engine component comprising at least two layers: a metal layer and an insulation layer, the inner metal layer adapted to be positioned directly proximal to a shielded component, said insulation layer positioned outwardly of said metal layer, said layers collectively providing thermal insulation of, and reduced noise transmission from, said component, said heat shield further comprising at least one bolt aperture to facilitate attachment of said shield to said engine component, wherein said aperture is surrounded by at least one non-planar undulation defining a circumferential protuberance spaced uniformly about said aperture of said heat shield.

2. The heat shield of claim 1, wherein said undulation is convex and defines a visible ring about said aperture, and is formed in both said insulation layer and said inner metal layer.

3. The heat shield of claim 2, wherein said undulation is effective to reduce transmittal of vibration and noise though said heat shield.

4. The heat shield of claim 3, wherein said component comprises an exhaust manifold fixed to engine, adapted to carry hot engine gases away from said engine.

5. The heat shield of claim 4, wherein there are at least two of said undulations, defining visible, concentrically positioned rings formed about said aperture.

6. A heat shield for an under-the-hood vehicular engine component comprising three layers; an outer metal layer, an insulation layer, and an inner metal layer adapted to be positioned directly proximal to a shielded component; said insulation layer positioned intermediately between said metal layers, said layers collectively providing thermal insulation of, and reduced noise transmission from, said component, said heat shield further comprising at least one bolt aperture to facilitate attachment of said shield to a shielded component, wherein said aperture is surrounded by at least one convex undulation defining a circumferential protuberance spaced uniformly about said aperture of said heat shield.

7. The heat shield of claim 6, wherein said component comprises an exhaust manifold fixed to engine, adapted to carry hot engine gases away from said engine.

8. The heat shield of claim 7, wherein said undulation is effective to reduce transmittal of vibration and noise though said heat shield.

9. The heat shield of claim 8 wherein said inner metal layer directly adjacent said shielded component is adapted to reflect heat back to the shielded component.

10. The heat shield of claim 9, wherein there are at least two of said undulations, defining visible, concentrically positioned rings formed about said aperture.

11. A heat shield for an under-the-hood vehicular engine component comprising three layers: an outer metal layer, an insulation layer, and an inner metal layer adapted to be positioned directly proximal to the shielded component, said insulation layer positioned intermediately between said metal layers, said layers collectively providing thermal insulation of, and reduced noise transmission from, said component, and wherein said heat shield further comprising at least one bolt aperture to facilitate attachment of said shield to a shielded component, wherein said aperture is surrounded by at least one convex undulation defining a circumferential protuberance spaced uniformly about said aperture of said heat shield, and further wherein said component comprises an exhaust manifold fixed to engine, adapted to carry hot engine gases away from said engine.

12. A heat shield for an under-the-hood vehicular engine component comprising three layers: an outer metal layer, an insulation layer, and an inner metal layer adapted to be positioned directly proximal to the shielded component, said insulation layer positioned intermediately between said metal layers, said layers collectively providing thermal insulation of, and reduced noise transmission from, said component, wherein said heat shield further comprising at least one bolt aperture to facilitate attachment of said shield to a shielded component, wherein said aperture is surrounded by at least one convex undulation defining a circumferential protuberance spaced uniformly about said aperture of said heat shield, wherein said component comprises an exhaust manifold fixed to engine, adapted to carry hot engine gases away from said engine, and wherein said inner metal layer directly adjacent said shielded component is adapted to reflect heat back to the shielded component.

* * * * *